US011083303B2

(12) United States Patent
Hirschhaut

(10) Patent No.: US 11,083,303 B2
(45) Date of Patent: Aug. 10, 2021

(54) SEATING UNIT

(71) Applicant: Bruce Hirschhaut Designs, Inc., High Point, NC (US)

(72) Inventor: Bruce Hirschhaut, High Point, NC (US)

(73) Assignee: Bruce Hirschhaut Designs, Inc., High Point, NC (US)

( * ) Notice: Subject to any disclaimer, the term of this patent is extended or adjusted under 35 U.S.C. 154(b) by 0 days.

(21) Appl. No.: 16/714,054

(22) Filed: Dec. 13, 2019

(65) Prior Publication Data

US 2020/0221877 A1 Jul. 16, 2020

Related U.S. Application Data

(63) Continuation of application No. 16/173,452, filed on Oct. 29, 2018, now Pat. No. 10,506,883.

(60) Provisional application No. 62/672,645, filed on May 17, 2018.

(51) Int. Cl.

| | |
|---|---|
| ***A47C 17/04*** | (2006.01) |
| ***A47C 7/40*** | (2006.01) |
| ***A47C 31/00*** | (2006.01) |
| ***A47C 17/86*** | (2006.01) |

(52) U.S. Cl.

CPC ..... *A47C 17/04* (2013.01); *A47C 7/407* (2013.01); *A47C 17/86* (2013.01); *A47C 31/00* (2013.01)

(58) Field of Classification Search

CPC ..... B60N 2/206; B60N 2/3009; A47C 4/00; A47C 7/02; A47C 7/00; A47C 7/407; A47C 17/04; A47C 17/86; A47C 31/00; A47C 4/02

USPC ..... 297/382, 440.14, 234, 440.1, 378.12, 297/378.1, 16.1, 440.15

See application file for complete search history.

(56) References Cited

U.S. PATENT DOCUMENTS

| | | | | | |
|---|---|---|---|---|---|
| 986,686 | A * | 3/1911 | Carney | A47B 85/04 | 297/110 |
| 2,831,528 | A * | 4/1958 | Eames | A47C 7/407 | 297/296 |
| 3,148,892 | A * | 9/1964 | Merriott | B25H 5/00 | 280/32.6 |
| 3,658,382 | A * | 4/1972 | Anderson | A47C 4/02 | 297/248 |
| 5,069,503 | A * | 12/1991 | Martinez | A47C 1/146 | 297/256 |
| 5,647,632 | A * | 7/1997 | Fireman | A47B 85/00 | 297/109 |
| 7,527,337 | B2 * | 5/2009 | Clay | A47C 7/407 | 297/378.12 |
| 7,735,914 | B2 * | 6/2010 | Longnecker | A47C 13/00 | 297/125 |

(Continued)

*Primary Examiner* — Milton Nelson, Jr.

(74) *Attorney, Agent, or Firm* — MacCord Mason PLLC

(57) ABSTRACT

A seating unit such as a chair, daybed, love seat or sofa. The seating unit includes a base adapted to provide a seating surface for a user and a seat back adapted to provide a surface for supporting a back of the user. A flexible joint connects the seat back as a cantilever to the base creating a horizontal pivot adapted for rotating the seat back along its Z-axis between a first stowed position and a second deployed position while substantially preventing movement of the seat back along its X-axis and Y-axis. In one embodiment, the base is a split base comprising a first portion and a second portion foldable for storage and shipping and unfoldable for use.

24 Claims, 14 Drawing Sheets

(56) References Cited

U.S. PATENT DOCUMENTS

2012/0019038 A1* 1/2012 Mezzera ..... A47C 7/02
297/440.15

* cited by examiner

SEATING UNIT

BACKGROUND OF THE INVENTIONS

(1) Field

The present inventions relate generally to seating units and, more particularly, to a seating unit for indoor and outdoor furniture which may be easily assembled and disassembled.

(2) Related Art

E-commerce has changed the expectations of consumers when shopping for goods online. The advent of free and expedited shipping policies for many products has resulted in many consumers expecting their goods to arrive shortly after placing their order. Yet in the furniture industry, these consumer expectations have not been met due to the weight, size and overall complexity of the furniture pieces being shipped. A consumer must typically wait several weeks before the furniture is finally delivered. Moreover, shipping costs remain high due to the furniture's weight.

Some furniture companies have resorted to providing furniture pieces that are packaged as individual components to be assembled by the consumer. Unfortunately, the assembly process comprises many steps and oftentimes the pieces used for the furniture are of poorer quality to save on overall build costs.

Thus, there remains a need for a seating unit having a low weight and occupies a minimal amount of space for shipping and storage while, at the same time, is durable and easy to assemble for use and to disassemble for storage.

SUMMARY OF THE INVENTIONS

The present inventions are directed to a seating unit such as a chair, daybed, love seat or sofa. The seating unit includes a base adapted to provide a seating surface for a user and a seat back adapted to provide a surface for supporting a back of the user. A flexible joint connects the seat back as a cantilever to the base creating a horizontal pivot adapted for rotating the seat back along its Z-axis between a first stowed position and a second deployed position while substantially preventing movement of the seat back along its X-axis and Y-axis. In one embodiment, the horizontal pivot is positioned between about 10% and about 33% from the distal end of the bottom edge of the seat back thereby reducing the force to less than 9 to 1 to about 2 to 1 with respect to the top edge of the seat back. In one embodiment, the base is a split base comprising a first portion and a second portion foldable for storage and shipping and unfoldable for use.

In one embodiment, the horizontal pivot is positioned between about 20% and about 33% from the distal end of the bottom edge of the seat back thereby reducing the force to less than 4 to 1 to about 2 to 1 with respect to the top edge of the seat back. In another embodiment, the horizontal pivot is positioned between at about 25% from the distal end of the bottom edge of the seat back thereby reducing the force to less than 3 to 1 with respect to the top edge of the seat back.

Also, in one embodiment, the seat back and the base have an angle between about 90° and about 120°. In another embodiment, the angle is between about 100° and about 110°. In still another embodiment, the angle is about 105°.

The flexible joint may be a horizontally mounted continuous hinge. In one embodiment, the hinge is a continuous hinge having a first leaf attached to the bottom edge of the seat back and a second leaf attached to the top edge of the base. In one embodiment, the first leaf may be attached to the front face of the bottom edge of the seat back and the second leaf is attached to the front face of the top edge of the back rail.

The seating unit may further including cushioning between the adjacent butt ends of the seat back and the back rail adapted to provide deflection flexibility of the seat back to provide comfort to the user. Also, the seating unit may further include a latch for securing the seat back in the second deployed position. In one embodiment, the latch comprises a metal plate having an opening attached to the bottom edge of the seat back and a spring-loaded pin attached to a back rail of the base, whereby the seat back is rotated from the first position into the second position and the spring-loaded pin is inserted into the opening of the metal plate.

The split base may include a continuous hinge connecting the first portion and the second portion. The split base may further include a face plate to conceal a gap between the first portion and the second portion on an outer face of the base.

In one embodiment, the base is comprised of a back rail with at least one flat side and a front rail. The base may further include a pair of side rails. The seating unit may further including a support frame attached to the base. In one embodiment, the support frame is comprised of metal. The support frame may further include an armature adapted to reinforce the support frame.

The seating unit may further include at least one arm support attached to the base. In one embodiment, the arm support is attached to the base with a knob bolt. A Belleville conical spring washer may be used with the knob bolt adapted to provide additional structural stability to the arm support. Also, a step ledge on the arm support may be adapted to assist with aligning the arm support with the base. In one embodiment, the step ledge is magnetic adapted to further secure the alignment between the arm support and the base.

The seating unit may further include a plurality of support legs attached to the base adapted to elevate the base for either functional or aesthetic purposes.

The seating unit may further include at least one seat cushion on the support frame. In one embodiment, the seat cushion is comprised of a foam. The foam may further include a joint adapted for folding the foam. In one embodiment, the joint is a miter joint having a 45 degree angle. The seat cushion may further include a slip cover on the seat cushion.

The seating unit may further include a center support leg attached at or near a center of the base. In one embodiment, the center support leg is pivotably attached to the base.

Accordingly, one aspect of the present inventions is to provide a seating unit including (a) a base adapted to provide a seating surface for a user; (b) a seat back adapted to provide a surface for supporting a back of the user; and (c) a flexible joint connecting the seat back as a cantilever to the base creating a horizontal pivot adapted for rotating the seat back along its Z-axis between a first stowed position and a second deployed position while substantially preventing movement of the seat back along its X-axis and Y-axis.

Another aspect of the present inventions is to provide a seating unit including (a) a base adapted to provide a seating surface for a user; (b) a seat back adapted to provide a surface for supporting a back of the user; and (c) a flexible joint connecting the seat back as a cantilever to the base creating a horizontal pivot adapted for rotating the seat back along its Z-axis between a first stowed position and a second deployed position while substantially preventing movement of the seat back along its X-axis and Y-axis, wherein the horizontal pivot is positioned between about 10% and about 33% from the distal end of the bottom edge of the seat back thereby reducing the force to less than 9 to 1 to about 2 to 1 with respect to the top edge of the seat back.

Still another aspect of the present inventions is to provide a seating unit including (a) a base adapted to provide a seating surface for a user; (b) a seat back adapted to provide a surface for supporting a back of the user; (c) a flexible joint connecting the seat back as a cantilever to the base creating a horizontal pivot adapted for rotating the seat back along its Z-axis between a first stowed position and a second deployed position while substantially preventing movement of the seat back along its X-axis and Y-axis, wherein the horizontal pivot is positioned between about 10% and about 33% from the distal end of the bottom edge of the seat back thereby reducing the force to less than 9 to 1 to about 2 to 1 with respect to the top edge of the seat back; and wherein the base is a split base comprising a first portion and a second portion foldable for storage and shipping and unfoldable for use.

Another aspect of the present inventions is to provide a kit for a seating unit including (a) a split base comprising a first portion and a second portion foldable for storage and shipping and unfoldable for use, where the split base adapted to provide a seating surface for a user; (b) a seat back adapted to provide a surface for supporting a back of the user; (c) a flexible joint connecting the seat back as a cantilever to the base creating a horizontal pivot adapted for rotating the seat back along its Z-axis between a first stowed position and a second deployed position while substantially preventing movement of the seat back along its X-axis and Y-axis; (d) a pair of arm supports configured to connect to the base; (e) a pair of support legs configured to connect to the base to provide elevation and additional support; and (f) a seating cushion comprised of a foldable foam having a miter joint adapted for folding the foam. In one embodiment, the kit may further include a cover having a U-shaped zipper and adapted to receive the seating cushion.

These and other aspects of the present inventions will become apparent to those skilled in the art after a reading of the following description of embodiments when considered with the drawings.

DESCRIPTION OF THE EMBODIMENTS

Figure 1:
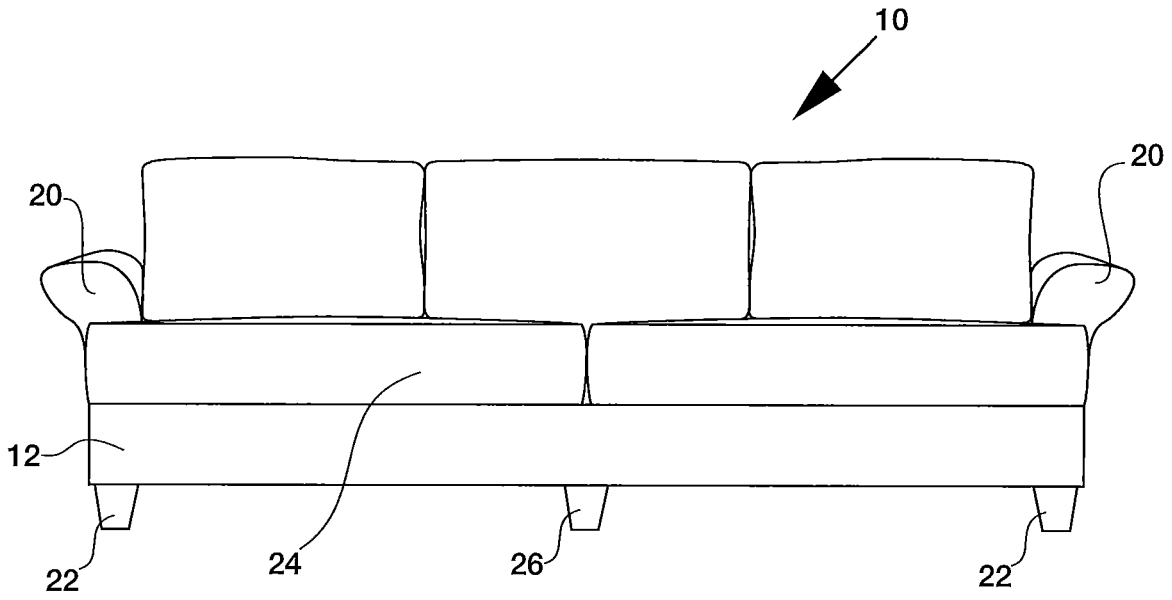
FIG. 1 is a front elevation view of one embodiment of a seating assembly constructed according to the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 2:
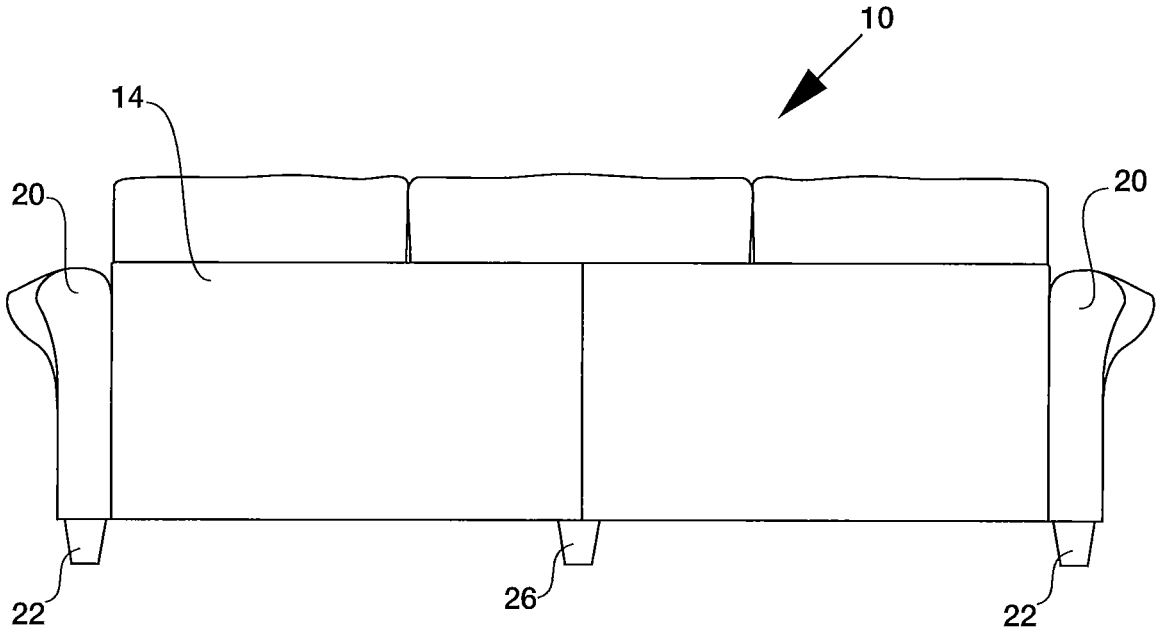
FIG. 2 is a back elevation view of the embodiment shown in FIG. 1.
Figure 3:
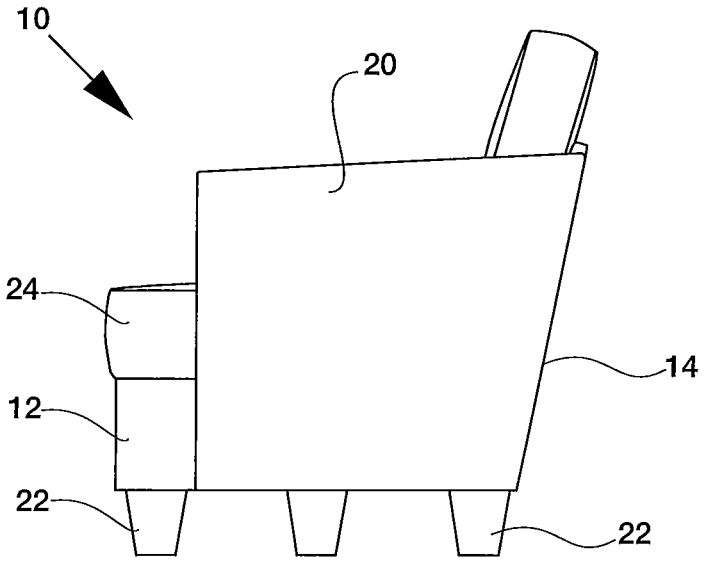
FIG. 3 is a left side elevation view of the embodiment shown in FIG. 1.

Referring now to the drawings in general and FIG. 1 in particular, it will be understood that the illustrations are for the purpose of describing a preferred embodiment of the inventions and are not intended to limit the inventions thereto. As best seen in FIGS. 1 through 3, a seating unit generally designated 10 comprises a base 12 for providing a seating surface for a user and a seat back 14 that provides a surface for resting a user's back while seated.

The seating unit 10 may also feature additional components, such as a pair of side arms 20. The pair of side arms 20 may be installed onto base 12. The seating unit may further include a pair of support legs 22 that can provide elevation and additional support to the seating unit 10. The base 12 may also include at least one seating cushion 24 to provide a comfortable surface for a user to sit on. The seating unit 10 may further include at least one center support leg 26 to provide further structural support to the seating unit.

Figure 4:
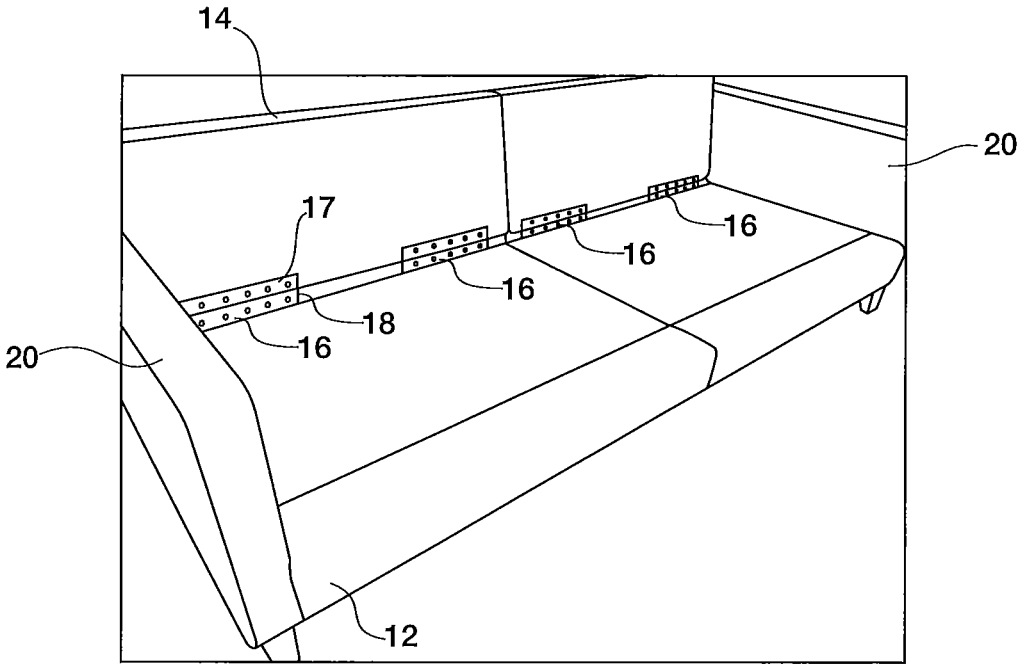
FIG. 4 is a front perspective view of a seating unit with a flexible joint shown connecting the seat back to the base.

Turning next to FIG. 4, the seating back 14 is connected to the base 12 as a cantilever via a flexible joint 16. The flexible joint 16 enables the seat back 14 to rotate on a Z-axis while substantially preventing translational movement of the seat back 14 on either the X-axis or Y-axis. As the seat back 14 rotates along the Z-axis, it can transition between a first stowed position and a second deployed position. Providing a mechanism by which the seat back 14 may transition between a first stowed position and a second deployed position is useful for shipping the product, moving the seating unit, or storing the sofa when not in use. The flexible joint 16 also enables easy assembly and disassembly of the seating unit by simply rotating the seat back 14 into the desired position.

In one embodiment as shown in FIG. 4, the flexible joint 16 comprises a continuous hinge in a horizontal configuration. The continuous hinge 16 includes a first leaf 17 installed onto a bottom edge of the seat back 14 and a second leaf 18 installed onto a back rail 32 of the base 12. The first leaf 17 is mounted on the front face of the bottom edge of the seat back 12 and the second leaf 18 is attached to the front face of the top edge of the back rail. When the seat back 14 is rotated toward a first stowed position, the angle between the first leaf 17 and the second leaf 18 decreases. As the seat back 14 is rotated toward a second deployed position, the angle between the first leaf 17 and the second leaf 18 increases. Mounting the first leaf 17 and second leaf 18 onto the front faces of the seat back 12 and back rail 32 provides greater load displacement and structural stability to the seating unit than would be obtained by installing the first leaf 17 and second leaf 18 onto the abutting edges such as a door is typically mounted to its frame.

Figure 5:
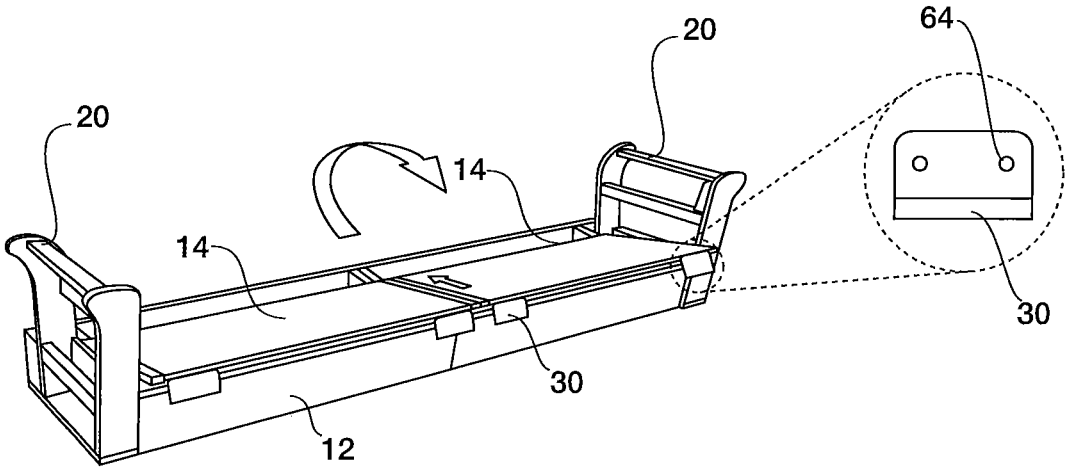
FIG. 5 is a rear perspective view of a seating unit wherein the seat back is in a first stowed position.

FIG. 5 shows a configuration of the seating unit 10 wherein the seat back 14 is in a first stowed position. A latch 30 may be further included in some embodiments to secure the seat back 14 onto base 12 when seat back 14 is in a second deployed position. As seen in this embodiment, the latch 30 includes one or more holes 64 adapted for receiving a pin installed onto the base 12.

Figure 6:
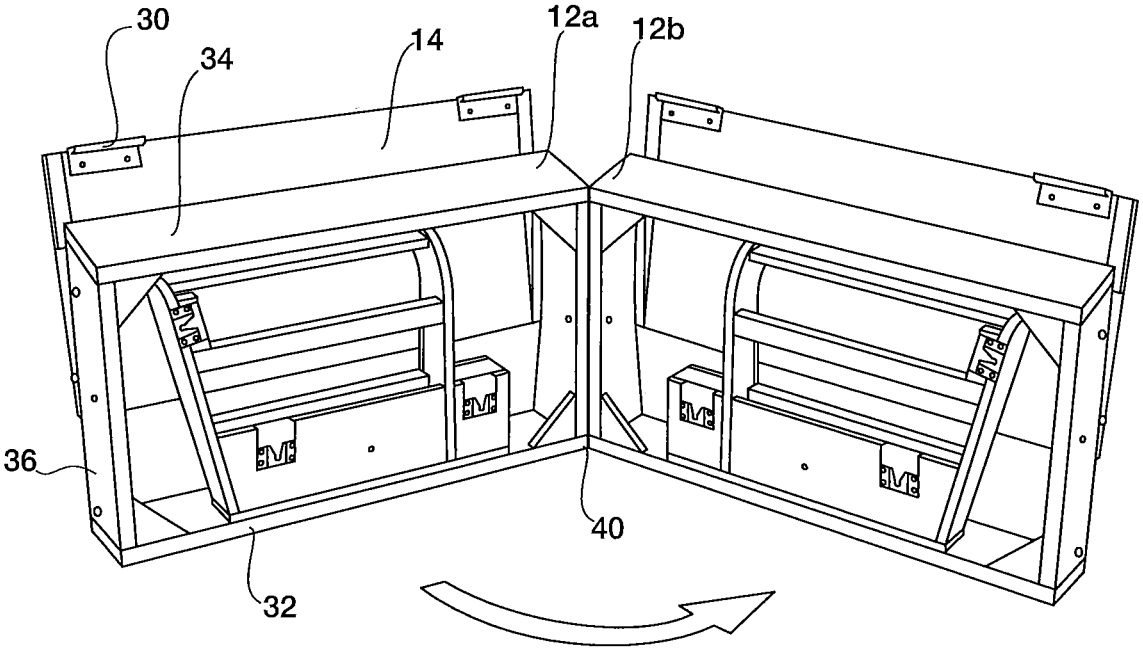
FIG. 6 is a bottom perspective view of a seating unit having a split base with the first portion and second portion partially folded and wherein the seat back is in a first stowed position.
Figure 7:
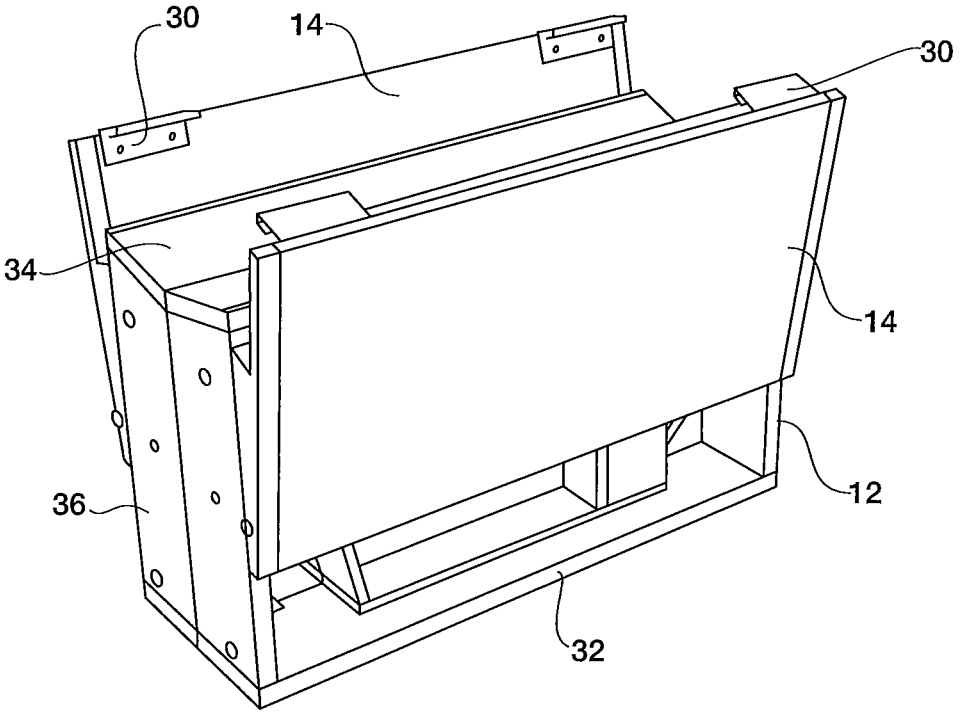
FIG. 7 is a bottom perspective view of a seating unit having a split base with the first portion and second portion folded and wherein the seat back is in a first stowed position.

FIG. 6 illustrates additional features that may be found in alternative embodiments of the seating unit 10. In the embodiment shown, the base 12 is a split base comprised of a first portion 12*a* and second portion 12*b* that can be folded along hinge 40. Each base may include a back rail 32 and a front rail 34. In some embodiments, the base 12 may further include a pair of side rails 36. The back rail 32 has at least one flat side so that the latch 30 can connect onto the back rail. In additional alternative embodiments, the back rail 32 may further include a curved profile shape in addition to a flat portion. FIG. 7 illustrates an embodiment wherein the base 12 is in a folded configuration and the seat back 14 is in a first stowed position, and suitable for packaging and shipment in a box.

Figure 8:
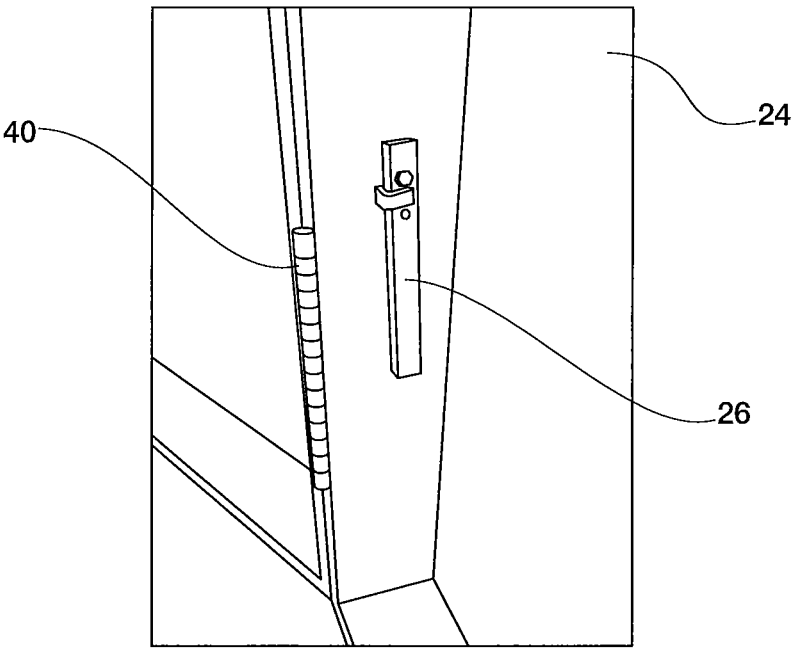
FIG. 8 is an enlarged bottom perspective view of a hinge for the split base according to one embodiment.
Figure 9:
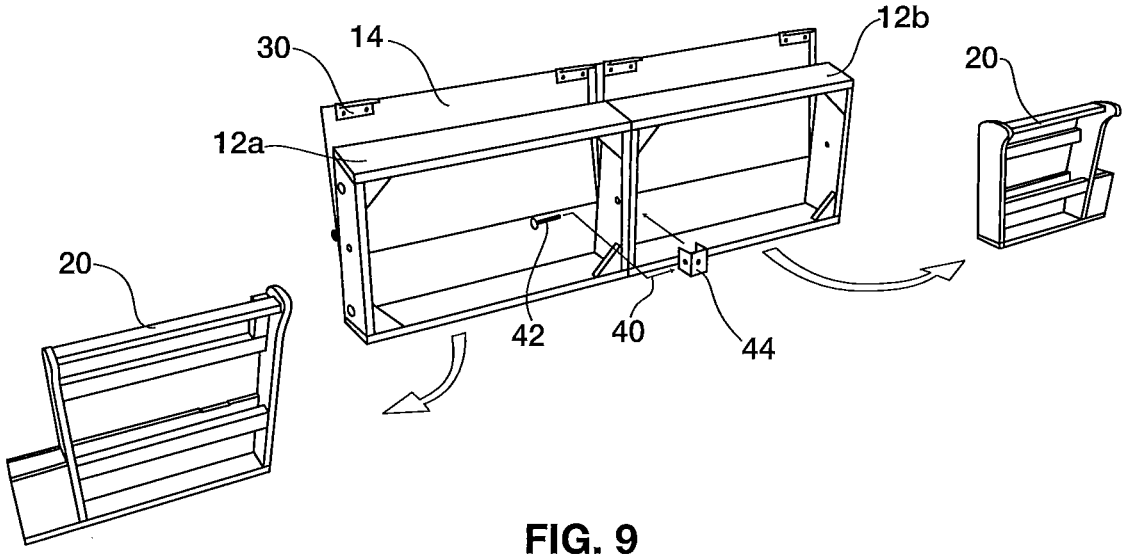
FIG. 9 is a bottom perspective view of a seating unit wherein the pair of side arms are disassembled.

FIG. 8 provides one example of a continuous hinge 40 that enables base 12*a* and base 12*b* to fold onto one another or conversely extend to a continuous surface. As can be seen in FIG. 9, the first portion 12*a* and the second portion 12*b* of the split base 12 may be secured in its extended configuration using a knob bolt 42 and clamp 44. Providing a foldable base provides additional advantages to the seating unit, including the ability to ship the seating unit in smaller containers as well as occupy less space when stored.

One embodiment of a center support leg 26 pivotably attached to the base 12 can be seen in FIG. 8. The center support leg 26 can be pivoted between a stowed position (as shown in FIG. 8) to a deployed position (seen in FIG. 17). In this embodiment, the seating unit 10 includes a pair of center support legs 26 that are offset and positioned toward the front and back of the base 12 to provide a uniform structure.

Figure 10:
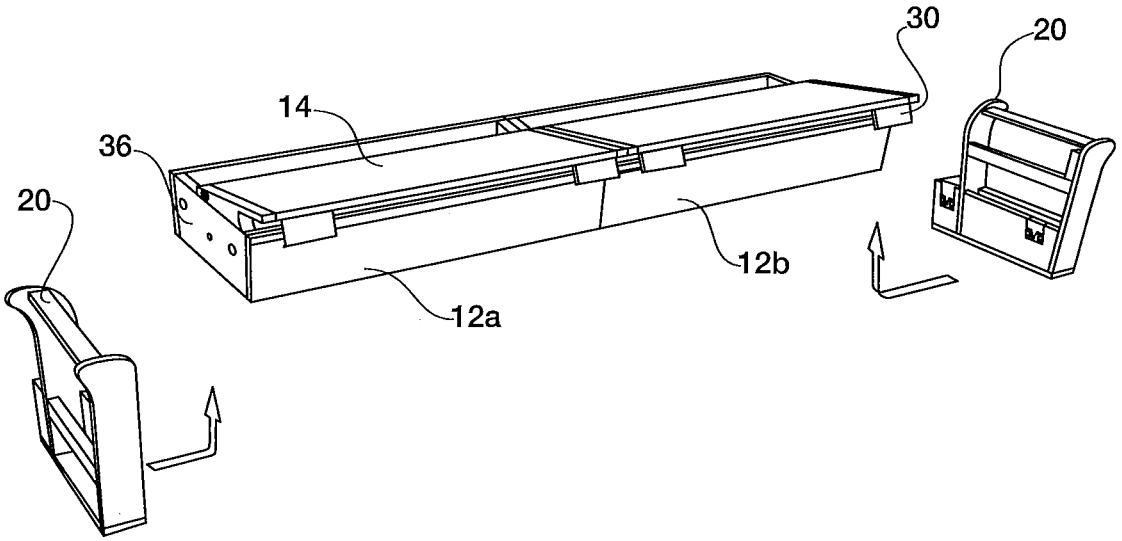
FIG. 10 is a rear perspective view of a seating unit wherein the pair of side arms are aligned to be assembled onto the side rail of the base.
Figure 11:
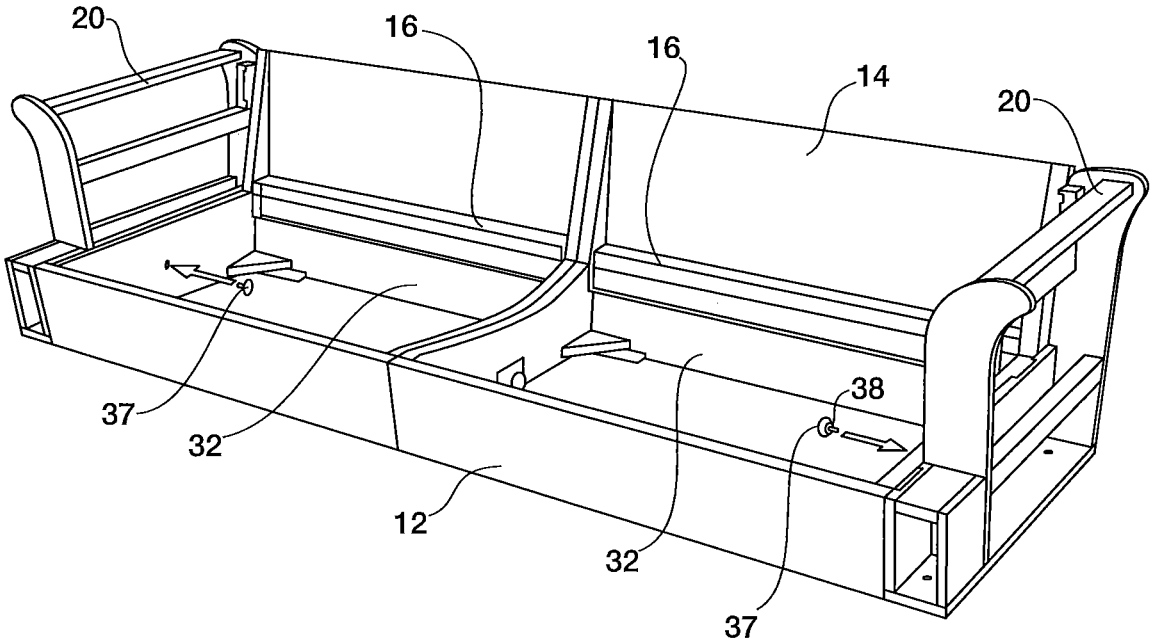
FIG. 11 is a partially disassembled front perspective view of a seating unit wherein the pair of side arms are installed onto the side rails of the base.

FIGS. 9 and 10 provide an example of the pair side arms 20 disassembled from the side rail 36. FIG. 11 illustrates the pair side arms 20 installed onto the side rail 36 and further secured with knob bolts 37. In some embodiments, a Belleville conical spring washer 38 may be accompanied with the knob bolts 37 to provide further stability to the pair side arms 20.

Figure 12:
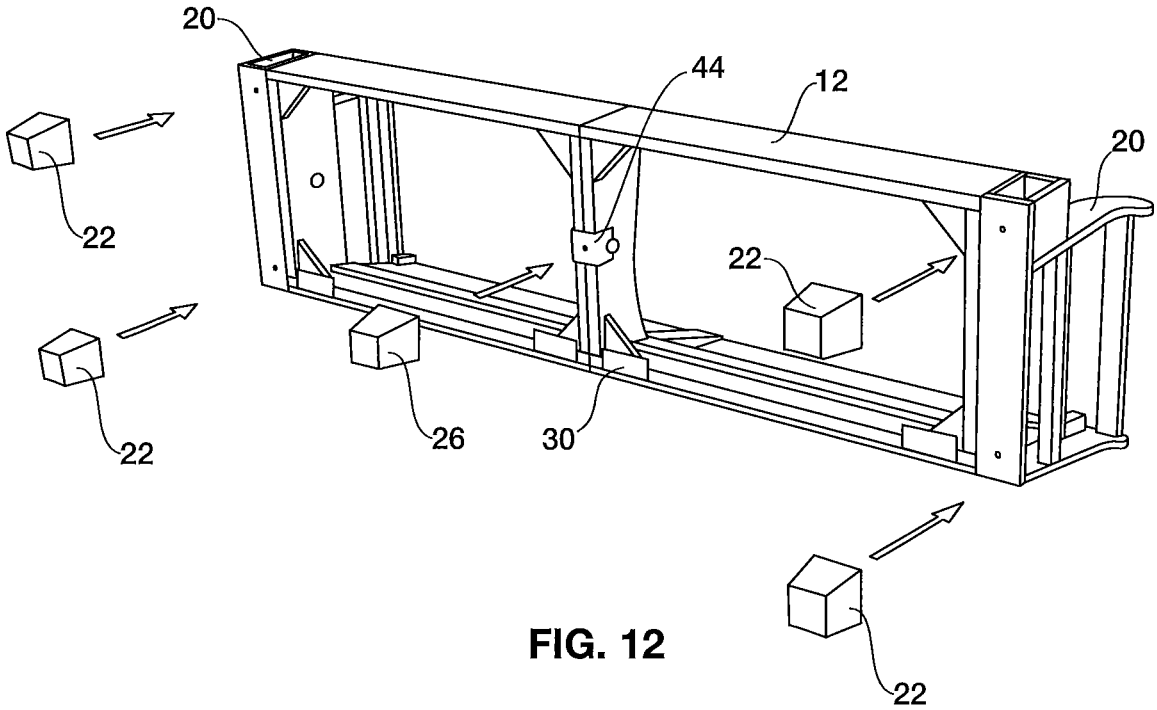
FIG. 12 is a bottom perspective view of a seating unit wherein the support legs are disassembled.
Figure 13:
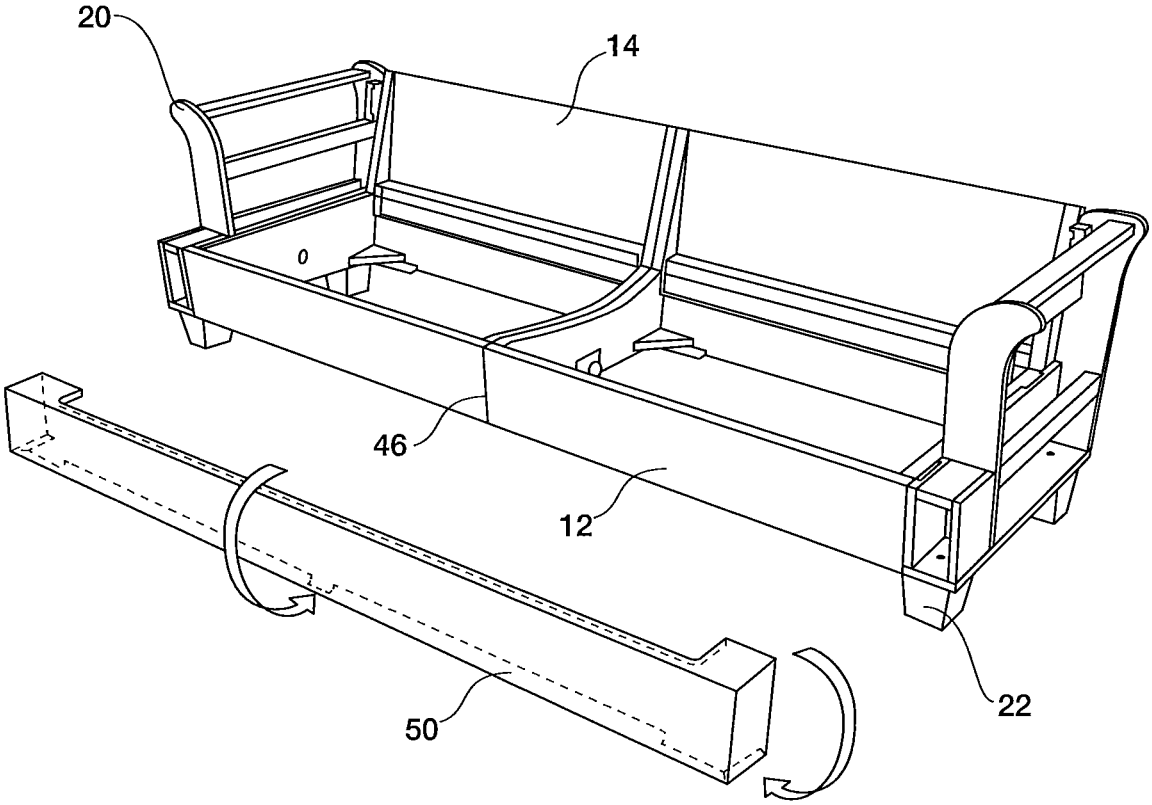
FIG. 13 is a front perspective view of a seating unit further including a face plate.

As can be seen in FIG. 12, a pair of support legs 22 may be installed onto the bottom of each pair of side arms 20. Additionally, a center support leg 26 can be installed onto the clamp 44. By providing a split base 12 to enable the base to fold into either a continuous surface or a storage configuration, a gap 46 may be visible to users. Thus, certain embodiments may further include a face plate 50 to conceal the gap 46. One example of the face plate 50 can be seen in FIG. 13.

Figure 14A:
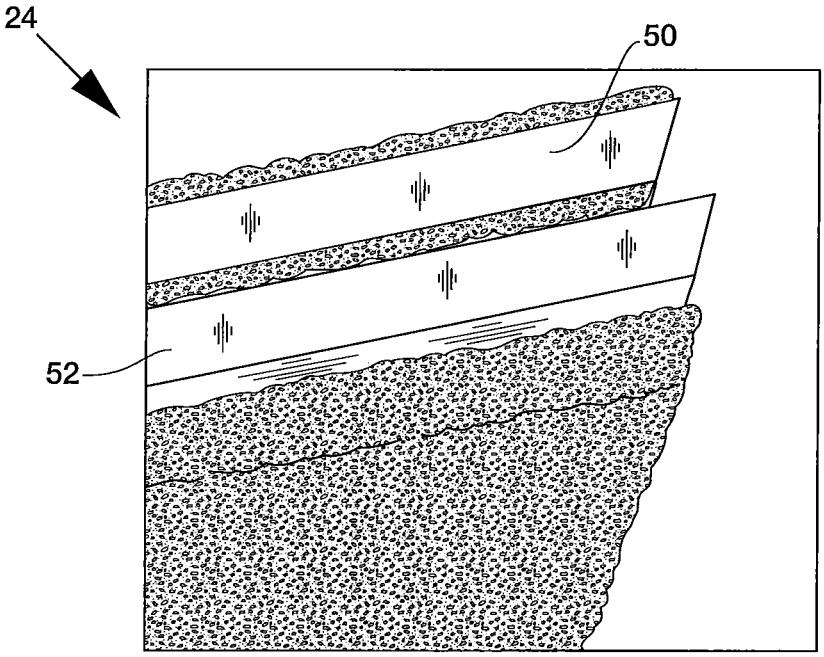
FIG. 14A is an enlarged side perspective view of a foldable seating cushion according to one embodiment of the present inventions.

FIG. 14A provides one embodiment of a seating cushion 24 that is foldable. Having a foldable seating cushion 24 enables the product to be shipped in a smaller package and also provides the option of storing the seating cushion 24 while occupying less space. In the embodiment shown, the seating cushion 24 is comprised of a foam having a first portion and a second portion 52 that provides a single continuous surface when in an unfolded configuration. The seating cushion 24 may also function as a sleeping surface.

Figure 14B:
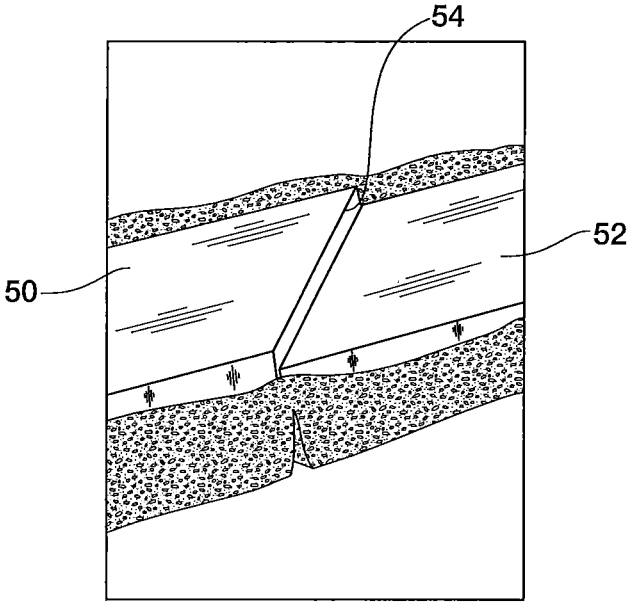
FIG. 14B is an enlarged side perspective view of the foldable seating cushion shown in FIG. 14A in an unfolded configuration.

Turning to FIG. 14B, the first portion and the second portion 52 may be foldable along a hinge 54. As seen in this embodiment, the hinge 54 may comprise a miter joint having about a 45 degree angle. A 45 degree angle is preferable to prevent the user from feeling a gap in the cushion when sitting or laying on its surface. However, in other embodiments the miter joint may comprise an angle less than or greater than 45 degrees.

Figure 15:
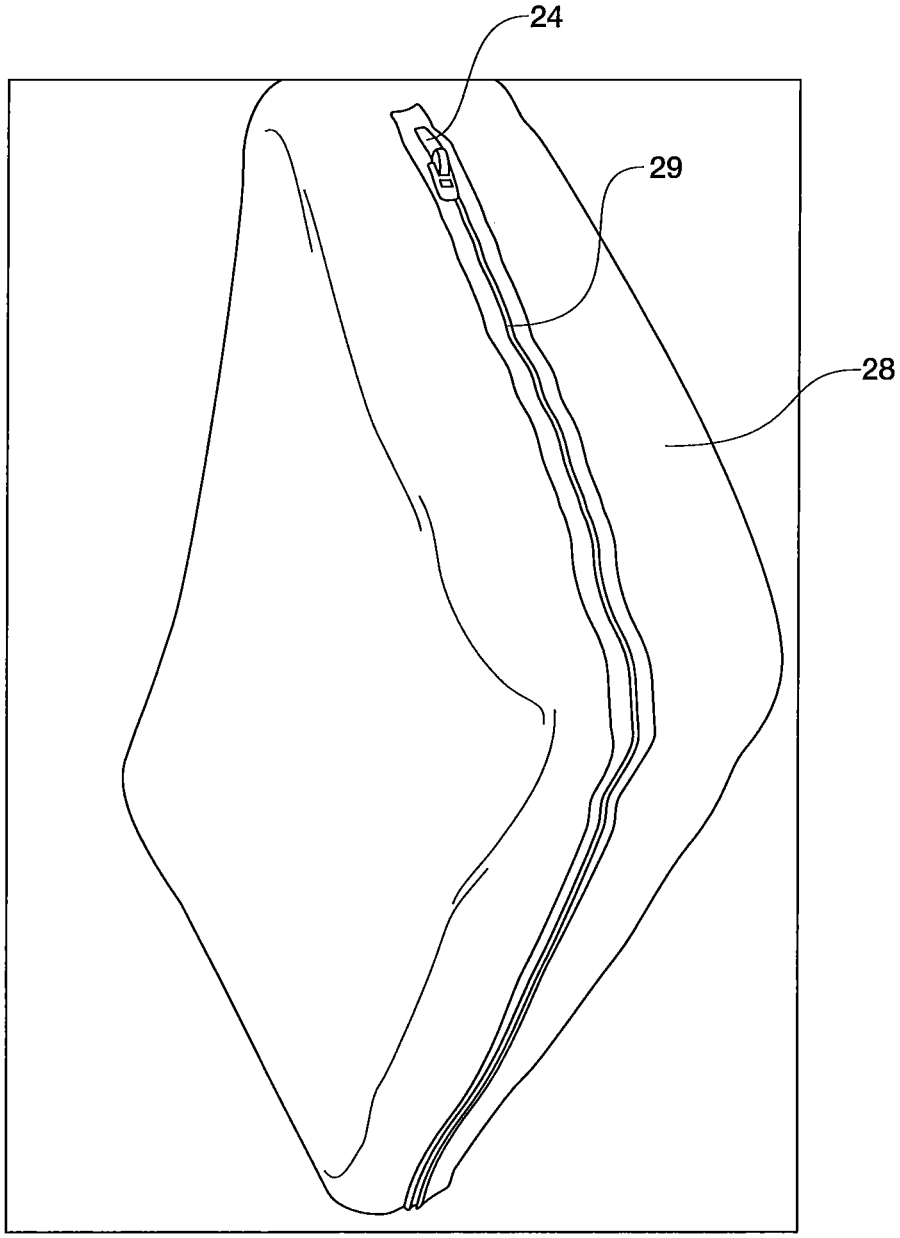
FIG. 15 is a side perspective view of a foldable seating cushion with a cover according to one embodiment of the present inventions.
Figure 16:
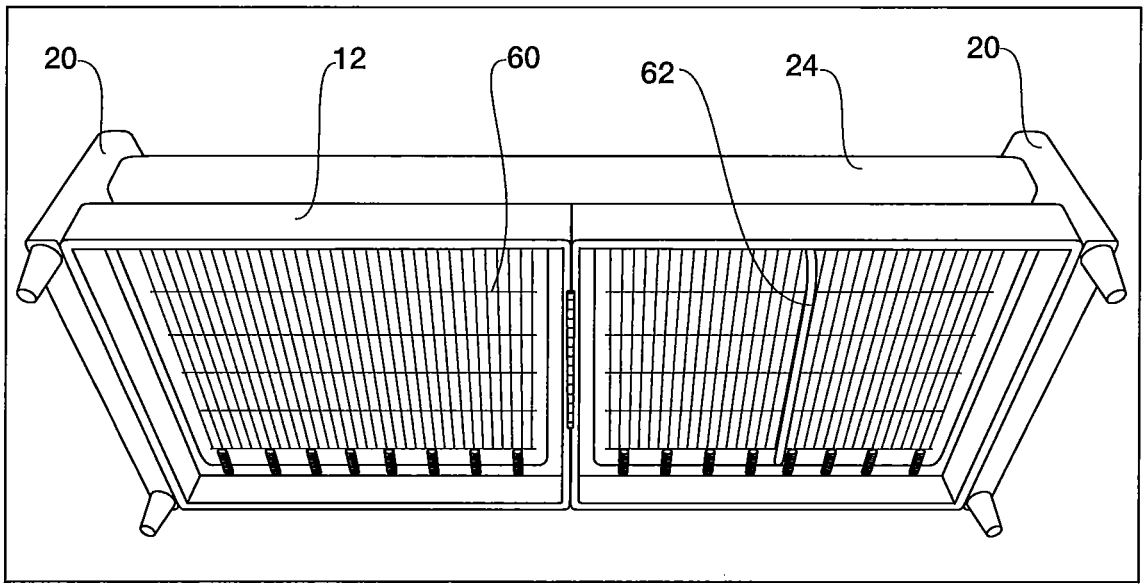
FIG. 16 is a bottom perspective view of a seating unit further including a support frame and armature according to one embodiment of the present inventions.

As seen in FIG. 15, the seating cushion 24 may be inserted into a cover. The cover 28 may further include a full U-shaped zipper design 29 along the side edges and a front or bottom edge of the cover 28. In the embodiment shown, the zipper 29 comprises an athletic sports zipper. The cover 28 and U-shaped zipper design 29 provides an easy means for a user to insert and remove a form from the cover 28, thus providing the option of a manufacturer to offer interchangeable covers. Additionally, the cover 28 and U-shaped zipper design 29 enables the seating cushion 24 to retain its shape.

In some embodiments the seating unit 10 may further include a support frame 60 to provide additional support to the seating cushion 24. The support frame 60 can be found installed on base 12. An armature 62 may also be included to provide additional structural stability to support frame 60. The armature 62 may be a folding armature that is pivotably attached to the support frame 60. The support frame 60 and armature 62 may be comprised of metal.

Figure 17:
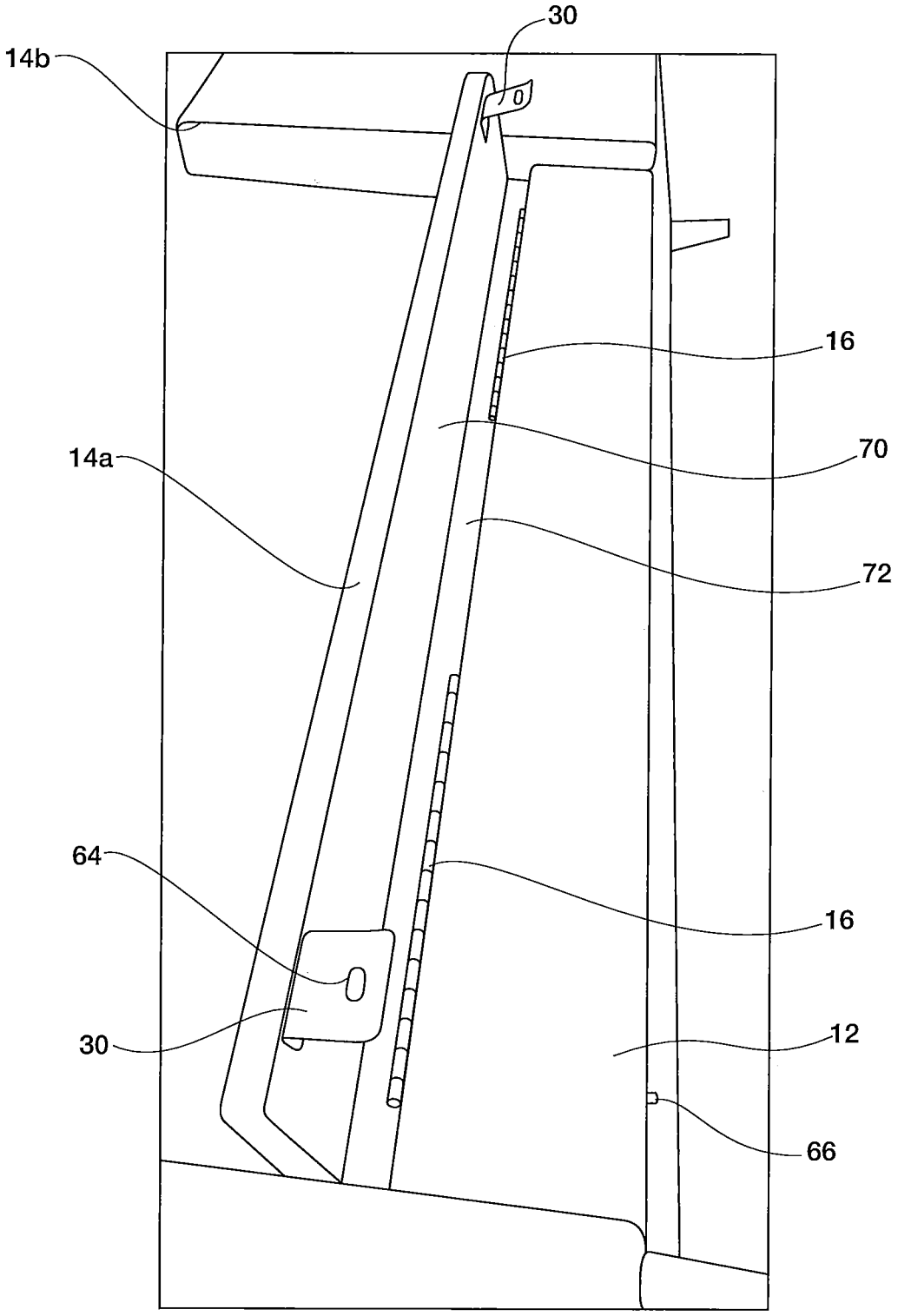
FIG. 17 is an enlarged rear perspective view of a seating unit with the seat back in a first stowed position according to one embodiment of the present inventions.
Figure 18:
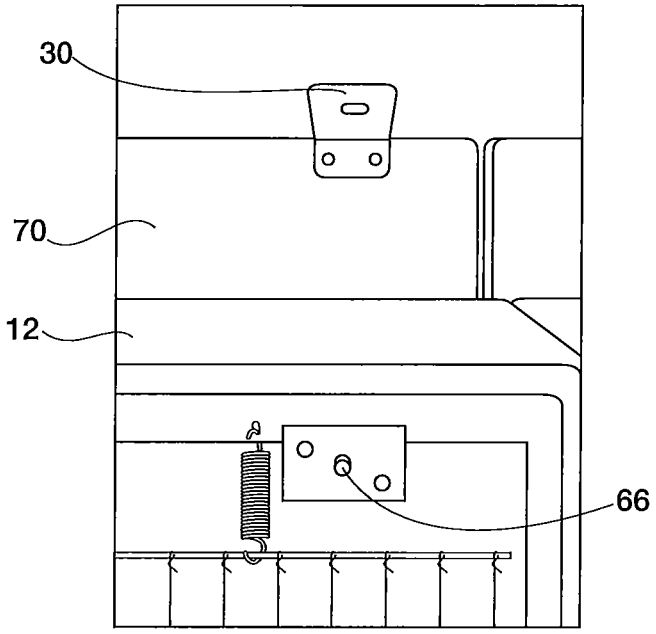
FIG. 18 is an enlarged bottom elevation view of a latch system of a seating unit with the seat back in a first stowed position.
Figure 19:
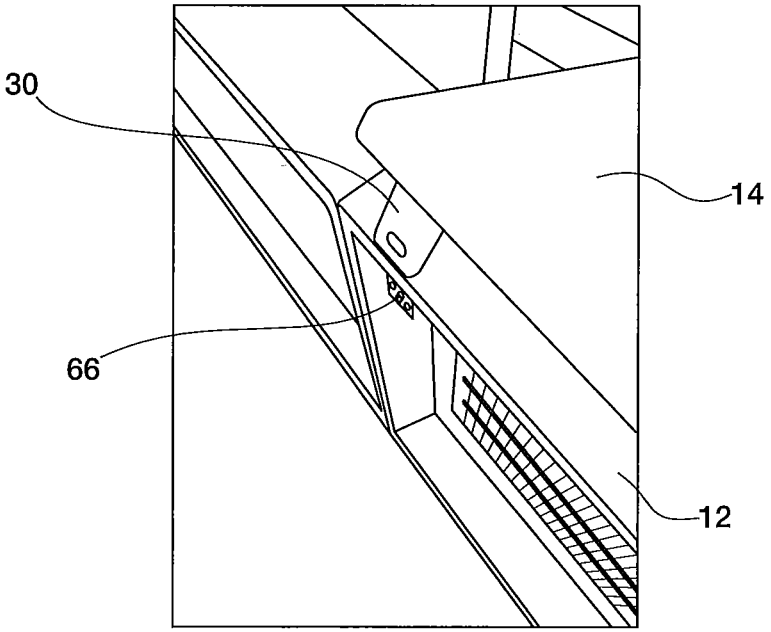
FIG. 19 is an enlarged rear perspective view of the latch system in FIG. 18 wherein the seat back is partially rotated from the first stowed position to the second deployed position.
Figure 20:
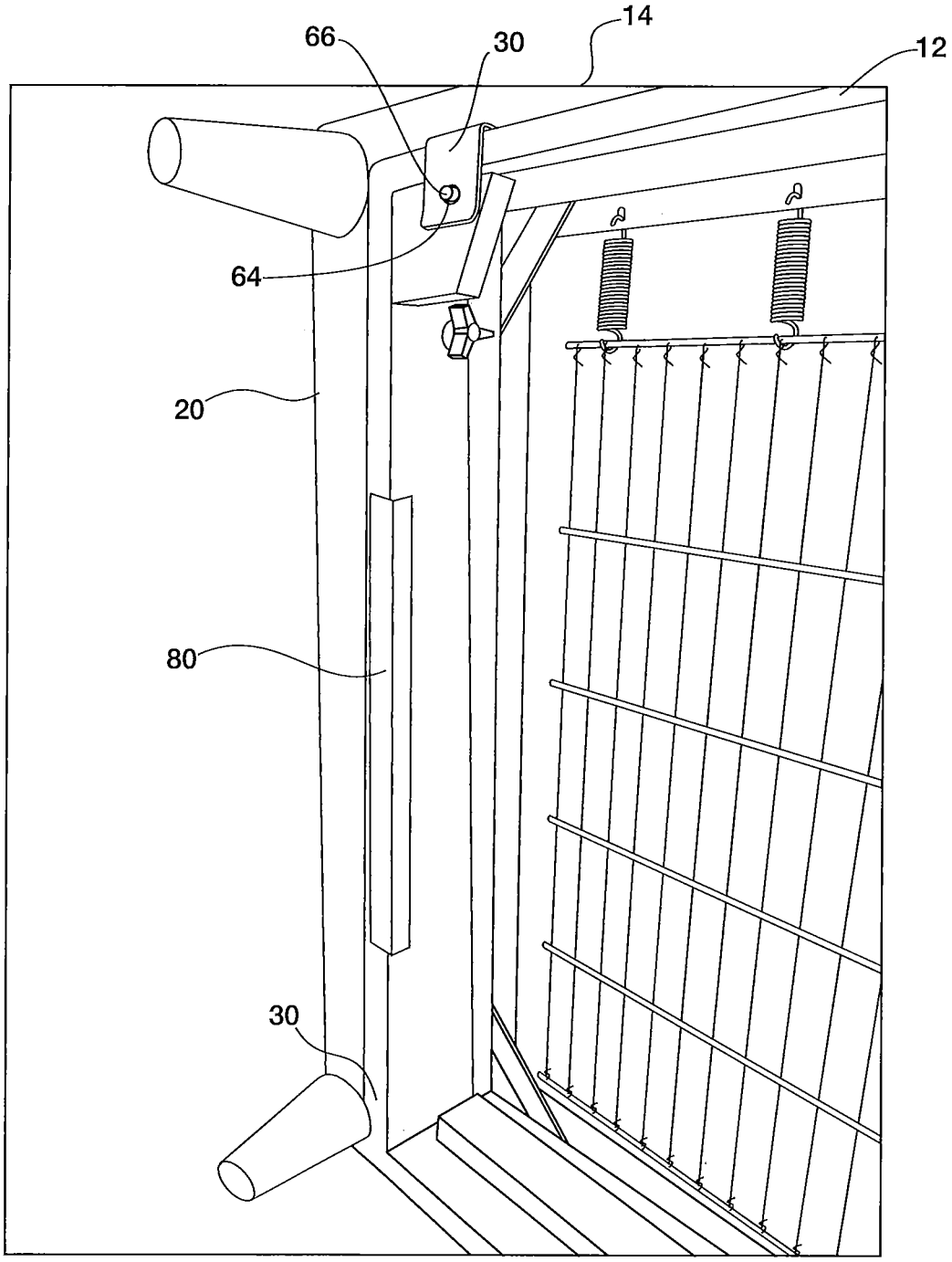
FIG. 20 is an enlarged bottom perspective view of a seating unit with the seat back rotated to the second deployed position and secured by a latch system.

Another embodiment of a latch 30 can be seen in FIG. 17. In this embodiment, the latch 30 is comprised of a metal plate having an opening 64 adapted to receive a spring loaded pin 66 that is found installed on a back rail 32 of base 12. FIGS. 18 through 20 show a series of progression where the seat back 14 is rotated toward the spring loaded pin 66 into the second deployed position. In these figures, the latch 30 is shown rotating toward the spring loaded pin 66 and in FIG. 20, the pin 66 is held within the opening 64 of latch 30, thus securing the seat back 14 into the second deployed position. To return the seat back 14 toward the first stowed position, the user may press in the spring loaded pin 66 to release the latch 30 and enable rotation of the seat back 14.

As seen in FIG. 20, certain embodiments of seating unit may include a step ledge 80 on each pair of side arms. The step ledge 80 facilitates alignment between the pair of side arms and the side rail 36 of base 12 during installation. In the embodiment shown, the step ledge 80 further includes a magnet to facilitate alignment. Incorporating a step ledge 80 also assists in offsetting the load weight bearing on knob bolt connectors attaching the pair of side arms 20 to side rail 36.

Figure 21:
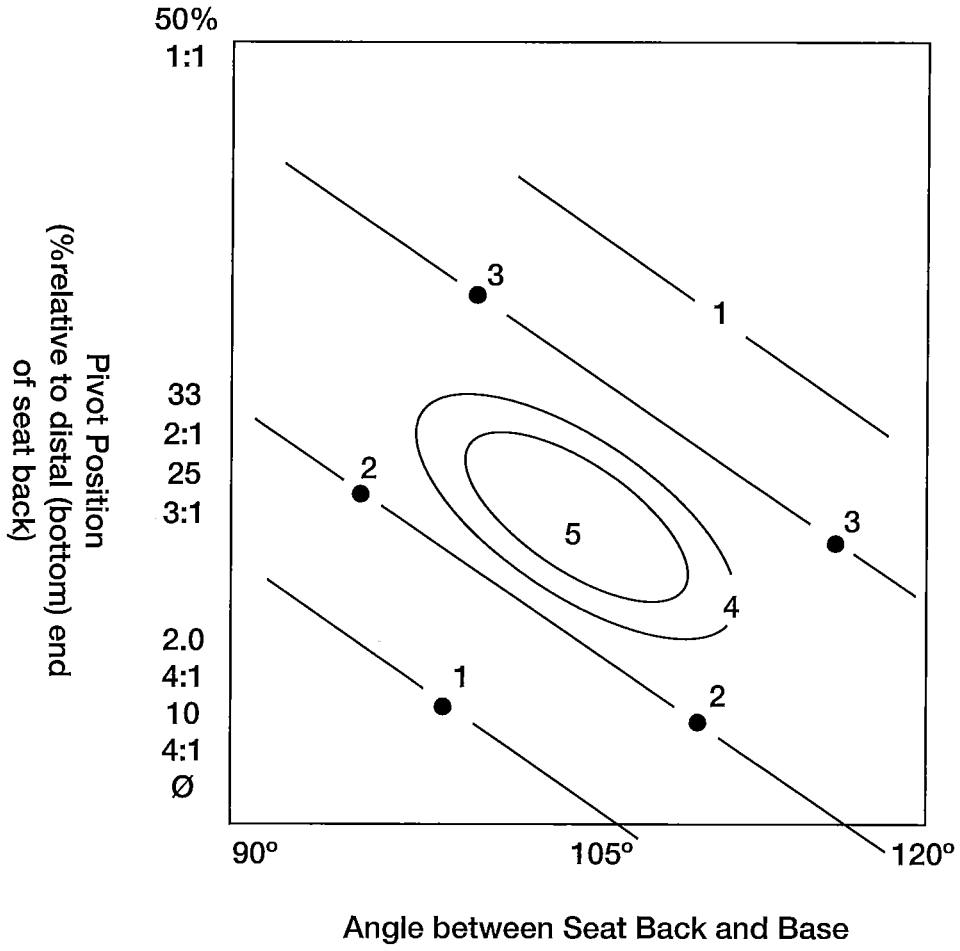
FIG. 21 is a graphical representation of a response surface illustrating the relationship of the pivot position and the deflection flexibility on the performance of seating units constructed according to the present inventions.

FIG. 21 is a graphical representation of a response surface illustrating the relationship of the pivot position from the flexible joint 16 and the angle of the seat back 14 in relation to the base 12 on the performance of the seating unit constructed according to the present inventions. The response surface provides a visual illustration of the effects of both the pivot position and the seat back angle of the seating unit via a two-dimensional surface plot of a three-dimensional surface.

Accordingly, the expected characteristics of various seating units, having variations in pivot position and deflection flexibility, were plotted and zones on the response surface were ranked from 1 to 5 with 1 being the least desirable seating units and 5 being the most desirable seating units in terms of the amount of load to be accommodated by the seat back, the slope of the seat back, the seat pitch, lumbar support, and weight of the seating unit. The boundary conditions in FIG. 21 are denoted with dashed lines, and indicate the range of pivot positions and deflection flexibility values for use in the present inventions.

As can be seen in FIG. 21, seating units having a pivot position between about 10% and about 33% from the distal end of the bottom edge of the seat back are more desirable, since the force is reduced to less than 9 to 1 to about 2 to 1 with respect to the top edge of the seat back. The horizontal pivot may preferably be positioned between about 20% and about 33% from the distal end of the bottom edge of the seat back thereby reducing the force to less than 4 to 1 to about 2 to 1 with respect to the top edge of the seat back. In a preferred embodiment, the horizontal pivot is positioned at about 25% from the distal end of the bottom edge of the seat back thereby reducing the force to less than 3 to 1 with respect to the top edge of the seat back.

A seat back having an angle of about 105° and a pivot positioned about 25% from the distal end of the bottom edge of the seat back is most desirable in terms of both comfort and the amount of load exerted onto the flexible joints. A seat back having an angle of 90° results in an upright rigid chair with more load exerted on the flexible joint. Having a seat back angle of about 120° or higher may result in a seating unit with a recline that is uncomfortable to a user while seated.

The amount of deflection flexibility when a user rests on a seat back is another factor in providing a comfortable seating experience. The positioning of the pivot point provides one method for adjusting the deflection flexibility of the seat back. However, the positioning of the pivot point is limited by concerns for durability. Another method for increasing the flexibility is by providing a softening material, such as a cushion, between the adjacent butt ends of the seat back and the back rail. In one embodiment, the seat back and rail are comprised of plywood and upholstered with a fabric to create a surface having a hardness ranging between about 25 and about 30 units, as measured by CHECKLINE Textile Durometer Model HP-2.5. In other embodiments, the seat back and rail may comprise an elasticized webbing or flex material to provide greater deflection flexibility.

Certain modifications and improvements will occur to those skilled in the art upon a reading of the foregoing description. By way of example, the seating unit may vary in dimensions, and as such, may comprise a seating unit other than a sofa, such as a chair. The seating unit may comprise a single unit or a series of modular single seating units comprising a split base wherein single seating units having an individual base may be joined together. In one embodiment, each seat back is independently supported by its cantilevered attachment to the base. However, independent seat backs may be further attached to adjacent seat backs or arms if additional rigidity is desired. Additionally, the seating unit may be upholstered using various materials, and may be further adapted as a seating unit for outdoor use. The seating unit may be comprised of a variety of materials, such as plywood, a wood-plastic composite, or metal. A fabricated metal corner bracket and a center strut may also be included to reinforce the base. Moreover, other hinges, joints and materials may be used to create a flexible joint connecting the seat back and the base. For example, a flexible material may be used as a flexible joint to connect the seat back as a cantilever to the base. Also, components of the seating unit may be packaged as a kit for a user to assemble into a seating unit. It should be understood that all such modifications and improvements have been deleted herein for the sake of conciseness and readability but are properly within the scope of the following claims.

I claim:

1. A seating unit comprising:

(a) a base adapted to provide a seating surface for a user and having a back rail;

(b) a seat back adapted to provide a surface for supporting a back of the user; and (c) a flexible joint connecting said seat back as a cantilever to said base creating a horizontal pivot adapted for rotating said seat back along its Z-axis between a first stowed position and a second deployed position while substantially preventing movement of said seat back along its X-axis and Y-axis, wherein said flexible joint comprises a horizontally mounted continuous hinge having a first leaf attached to the bottom edge of said seat back and a second leaf attached to the top edge of said base, wherein said horizontal pivot is positioned between about 10% and about 33% of a height of said seat back from a distal end of a bottom edge of said seat back, and wherein said distal end of said bottom edge abuts said back rail of said base in said second deployed position.

2. The seating unit of claim 1, wherein said base is a split base comprising a first portion and a second portion for storage and shipping.

3. The seating unit of claim 2, wherein said split base includes a continuous hinge connecting said first portion and said second portion.

4. The seating unit of claim 3 further including a face plate to conceal a gap between said first portion and said second portion on an outer face of said base.

5. A seating unit comprising:

(a) a base adapted to provide a seating surface for a user and having a back rail;

(b) a seat back adapted to provide a surface for supporting a back of the user, wherein said seat back and said base have an angle between about 90° and about 120°; and (c) a flexible joint connecting said seat back as a cantilever to said base creating a horizontal pivot adapted for rotating said seat back along its Z-axis between a first stowed position and a second deployed position while substantially preventing movement of said seat back along its X-axis and Y-axis, wherein said flexible joint comprises a horizontally mounted continuous hinge having a first leaf attached to the bottom edge of said seat back and a second leaf attached to the top edge of said base, wherein said horizontal pivot is positioned between about 10% and about 33% of a height of said seat back from the distal end of the bottom edge of said seat back, and wherein said distal end of a bottom edge substantially abuts said back rail of said base in said second deployed position.

6. The seating unit of claim 5, wherein said horizontal pivot is positioned between about 20% and about 33% of the height of said seat back from the distal end of the bottom edge of said seat back.

7. The seating unit of claim 6, wherein said horizontal pivot is positioned at about 25% of the height of said seat back from the distal end of the bottom edge of said seat back.

8. The seating unit of claim 5, wherein said angle is between about 100° and about 110°.

9. The seating unit of claim 8, wherein said angle is about 105°.

10. The seating unit of claim 5, wherein said first leaf is attached to the front face of the bottom edge of said seat back and said second leaf is attached to the front face of the top edge of said back rail of said base.

11. The seating unit of claim 10 further including cushioning between said distal end of a bottom edge of said seat back and said back rail of said base in said second deployed position adapted to provide deflection flexibility of said seat back to provide comfort to the user.

12. The seating unit of claim 5 further including a latch for securing said seat back in said second deployed position.

13. The seating unit of claim 12, wherein said latch comprises a metal plate having an opening attached to the bottom edge of said seat back and a spring-loaded pin attached to a back rail of said base, whereby said seat back is rotated from said first position into said second position and said spring-loaded pin is inserted into said opening of said metal plate.

14. A seating unit comprising:

(a) a base adapted to provide a seating surface for a user and having a back rail;

(b) a seat back adapted to provide a surface for supporting a back of the user, wherein said seat back and said base have an angle between about 90° and about 120°;

(c) a flexible joint connecting said seat back as a cantilever to said base creating a horizontal pivot adapted for rotating said seat back along its Z-axis between a first stowed position and a second deployed position while substantially preventing movement of said seat back along its X-axis and Y-axis, wherein said flexible joint comprises a horizontally mounted continuous hinge having a first leaf attached to the bottom edge of said seat back and a second leaf attached to the top edge of said base, wherein said horizontal pivot is positioned between about 10% and about 33% of a height of said seat back from the distal end of the bottom edge of said seat back, and wherein said distal end of said bottom edge abuts said back rail of said base in said second deployed position; and wherein said base is a split base comprising a first portion and a second portion for storage and shipping.

15. The seating unit of claim 14, wherein said split base includes a continuous hinge connecting said first portion and said second portion.

16. The seating unit of claim 15 further including a face plate to conceal a gap between said first portion and said second portion on an outer face of said base.

17. The seating unit of claim 14, wherein said horizontal pivot is positioned between about 20% and about 33% of the height of said seat back from the distal end of the bottom edge of said seat back.

18. The seating unit of claim 17, wherein said horizontal pivot is positioned at about 25% of the height of said seat back from the distal end of the bottom edge of said seat back.

19. The seating unit of claim 14, wherein said angle is between about 100° and about 110°.

20. The seating unit of claim 19, wherein said angle is about 105°.

21. The seating unit of claim 14, wherein said first leaf is attached to the front face of the bottom edge of said seat back and said second leaf is attached to the front face of the top edge of said back rail of said base.

22. The seating unit of claim 21 further including cushioning between said distal end of the bottom edge of said seat back and said back rail of said base in said second deployed position adapted to provide deflection flexibility of said seat back to provide comfort to the user.

23. The seating unit of claim 14 further including a latch for securing said seat back in said second deployed position.

24. The seating unit of claim 23, wherein said latch comprises a metal plate having an opening attached to the bottom edge of said seat back and a spring-loaded pin attached to a back rail of said base, whereby said seat back is rotated from said first position into said second position and said spring-loaded pin is inserted into said opening of said metal plate.

* * * * *